US006104674A

United States Patent [19]

Emoff et al.

[11] Patent Number: 6,104,674

[45] Date of Patent: Aug. 15, 2000

[54] TIMERS FOR ALERTING TASKS TO BE PERFORMED

[76] Inventors: Michael J. Emoff, 5450 Sherfield Dr., Trotwood, Ohio 45426; Thomas L. Emoff, 6014 Southampton Dr., Dayton, Ohio 45459

[21] Appl. No.: 09/270,970

[22] Filed: Mar. 17, 1999

Related U.S. Application Data

[60] Provisional application No. 60/078,294, Mar. 17, 1998, and provisional application No. 60/095,569, Aug. 6, 1998.

[51] Int. Cl.[7] ..... G04F 10/00; G04B 23/00

[52] U.S. Cl. ..... 368/109; 368/261

[58] Field of Search ..... 368/107–113, 10, 368/261; 340/457, 457.2, 457.4, 309.15, 309.3, 309.4, 309.5; 307/141, 141.4

[56] References Cited

U.S. PATENT DOCUMENTS

| | | | |
|---|---|---|---|
| 2,553,482 | 5/1951 | Smith . | |
| 2,730,340 | 1/1956 | Patriarca . | |
| 2,791,473 | 5/1957 | Mattox . | |
| 2,932,779 | 4/1960 | Tancig . | |
| 3,127,599 | 3/1964 | Smith et al. . | |
| 3,253,820 | 5/1966 | Seil . | |
| 3,546,693 | 12/1970 | Bissett et al. . | |
| 3,603,880 | 9/1971 | Brecker, Jr. et al. . | |
| 3,638,120 | 1/1972 | Jost . | |
| 3,961,473 | 6/1976 | Hung | 368/96 |
| 4,062,180 | 12/1977 | Meshi et al. | 368/109 |
| 4,209,972 | 7/1980 | Fukuichi . | |
| 4,218,871 | 8/1980 | Moritani et al. . | |
| 4,236,145 | 11/1980 | Schorsch . | |
| 4,404,641 | 9/1983 | Bazarnik . | |
| 4,539,632 | 9/1985 | Hansen et al. . | |
| 4,884,255 | 11/1989 | Fischer | 368/96 |
| 5,402,108 | 3/1995 | Tabin et al. . | |
| 5,408,224 | 4/1995 | Yamazaki et al. . | |
| 5,623,247 | 4/1997 | Cardillo . | |
| 5,705,977 | 1/1998 | Jones . | |
| 5,706,257 | 1/1998 | Rothman et al. . | |
| 5,854,774 | 12/1998 | Timme | 368/108 |

OTHER PUBLICATIONS

See Information Disclosure Statement regarding offer for sale less than one year prior to the filing date of the present application.

*Primary Examiner*—Vit Miska
*Attorney, Agent, or Firm*—Roger S. Dybvig

[57] ABSTRACT

A timer has as at least two timing intervals, at least one of which is switchable between different preset intervals by the user, between which tasks are to be performed by a user. Upon the expiration of each timing interval, the user is alerted that a task is to be performed. A display panel indicates the number of days remaining in one of the timing cycles and may temporarily be switched to indicate the number of days remaining in the other timing interval. A particular use for the timer of this invention is to remind a user to service a humidifier. Another particular use is to remind a user of chores to be performed to maintain indoor or outdoor plants.

12 Claims, 1 Drawing Sheet

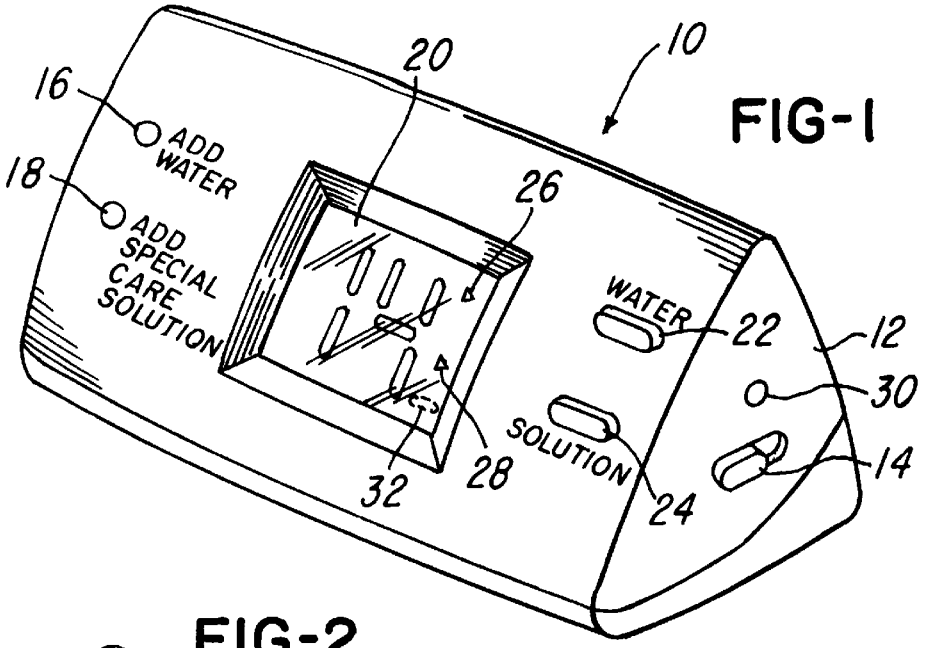
FIG-1
FIG-2
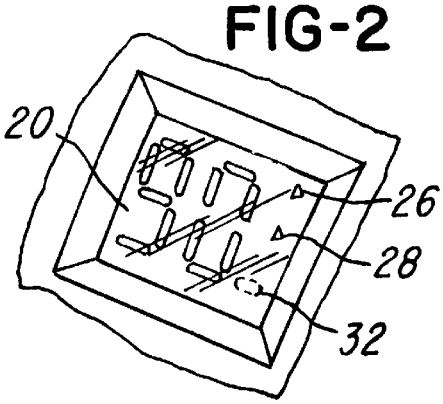
FIG-3
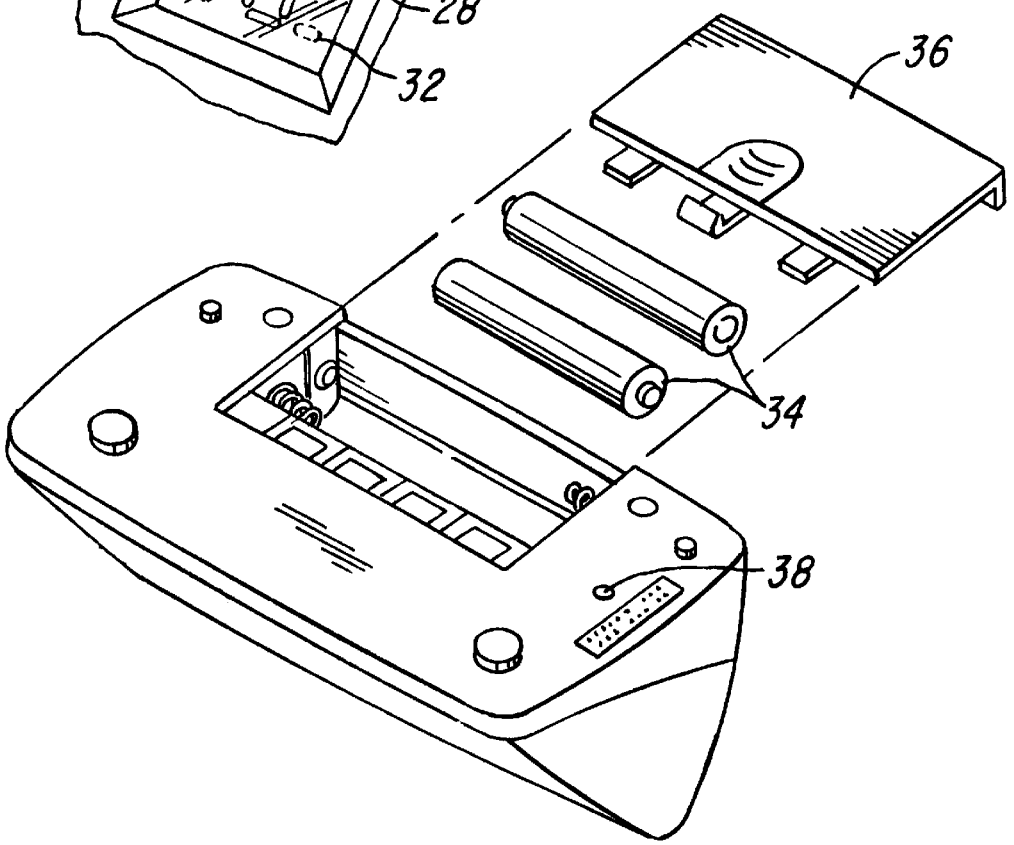

TIMERS FOR ALERTING TASKS TO BE PERFORMED

CROSS REFERENCE TO RELATED APPLICATIONS

This application claims the benefit of copending U.S. Provisional Application No. 60/078,294, filed Mar. 17, 1998, and copending U.S. Provisional Application No. 60/095,569, filed Aug. 6, 1998.

FIELD OF THE INVENTION

The present invention relates generally to timers that alert users of tasks to be performed. This invention is particularly directed to timers for use in connection with the servicing of humidors and to timers for use by persons in connection with the maintenance of indoor or outdoor plants. However, aspects of this invention may be used in connection with various other areas of endeavor requiring tasks to be performed on regular intervals.

BACKGROUND OF THE INVENTION

Timers which countdown from a predetermined amount of time and indicate either visually or with sound that the predetermined amount of time has elapsed are well known. However, there is a need for a single timer which can remind a user to perform two or more different tasks, where each task may be required at the expiration of different time intervals, and which the user can use to readily check to determine how much time is remaining before each of the two or more are to be performed.

A field in which timers could be used to remind the user to perform a number of routine maintenance tasks is in the maintenance of a humidifier for a humidor. Humidifiers are used within cigar humidors to maintain an acceptable humidity within the humidor to keep fresh and moist the cigars that are stored in the humidor. The timely addition of water is a task which easily can be forgotten.

Special care solutions, typically made from a combination of distilled water and propylene glycol, are also recommended to be added to humidors on regular intervals that are several months apart. A need to apply a special care solution, due to the long intervals between application of the solution, is a task which is also easily forgotten.

OBJECTS AND SUMMARY OF THE INVENTION

An object of this invention is to provide an improved timer by which multiple timing cycles extending over periods of at least several days, at least timing cycle being switchable to different preset timing intervals by the user, are provided so that a user is alerted upon the expiration of each timing cycle that a task is to be performed. More particularly, an object of this invention is to provide such a timer that will enable the user to readily determine the number of days remaining until each given task is to be performed.

A more specific object of one aspect of this invention is to provide a cigar humidor timer that will alert a user to refill the humidifier inside the humidor with water at the expiration of one timing cycle and will notify the user to add special care solution to the humidifier at the expiration of a different timing cycle.

Another more specific object of this invention is to provide a plant timer that may be used to notify a user who tends to the care of indoor or outdoor plants of dates for taking certain actions, such as the application of fertilizers or pesticides.

In accordance with the foregoing, the present invention comprises a timer for alerting a user that a first timing cycle and a second timing cycle have expired thereby reminding the user to perform separate tasks. In its preferred form, the timer is used to track two different timing cycles, both of which extend at least over a period of several days. The timer a housing which includes a timing interval switch, a first signal light, a second signal light, an alpha or numeric or alpha/numeric display panel for indicating the number of days left before a given task is to be performed that may be switched to indicate the number of days remaining before a second task is to be performed, a first reset button, and a second reset button.

The timing interval switch allows the user to select the timing interval in terms of days for the first timing cycle from a number of predetermined timing intervals. Upon the expiration of that first timing cycle, the first signal light is activated to visually indicating to the user that a task is to be performed. The first reset button is capable of simultaneously deactivating the first signal light and resetting the first timing cycle to the selected predetermined first timing interval so that the first timing cycle will commence counting down again for the predetermined first timing interval. The second signal light is activated upon the expiration of a second timing cycle preset at a fixed timing interval. The first and second timing intervals could be the same length, possibly starting at different times. However, more typically the first and second timing intervals will be of different lengths and therefore will expire at different times. The second reset button is also capable of simultaneously deactivating the second signal light and resetting the second timing cycle to the predetermined second timing interval. The display panel indicates the number of days remaining in one of the timing cycles and can be switched to indicate the days remaining in the other timing cycle.

The foregoing and other objects and advantages of this invention will become apparent from the following description and accompanying drawings.

BRIEF DESCRIPTION OF THE DRAWINGS

FIG. 1 is a perspective view of a humidor timer in accordance with this invention.

FIG. 2 is a fragmentary view of the LCD visual display of FIG. 1 showing the time remaining in the fixed interval timing cycle in response to pressing the second reset button.

FIG. 3 is a bottom perspective view of the humidor timer in FIG. 1.

DETAILED DESCRIPTION

With reference to FIG. 1, a humidor timer, generally designated 10, comprises a housing 12 including a timing interval switch 14, a first signal light 16, a second signal light 18, an LCD visual display panel 20, a first reset button 22, and a second reset button 24. Many interval timers include means which count down a specified amount of time including either a visual or sound alarm energized when the specified amount of time has elapsed. Electronic circuits are well known in the art which are capable of counting down from various predetermined timing intervals. The electronic circuit used in this invention (not shown) to independently count down two timing intervals in two separate timing cycles is readily available, well known to a person skilled in the art, and is therefore not discussed further herein.

Although the timer 10 can be used to remind a user of many other tasks, the disclosure herein describes a preferred embodiment of this invention wherein the timer 10 is used as an electronic humidor timer for notifying a user to add water to a humidifier after one timing interval and to add special care solution to the humidifier at the expiration of different timing interval.

The three position timing-interval switch 14 is located on a side wall of the housing 12 and is used to select a timing interval of, for example, 14, 21 or 28 days, between the dates on which water should normally be added to a humidor. The number of days remaining before the timer 10 will alert the user that water should be added is displayed on the visual display panel 20. When the first timer counts down to "0" days, the "add water" signal light 16 is energized, signaling the user to add water to the humidifier (or at least check to determine if water needs to be added). Although 14, 21 and 28 days are believed most useful, it is obvious that different numbers of days could be preset by the manufacturer and selected by operation of the three-position switch 14 by the user.

The setting of the timing interval switch 14 determines the countdown time for the first timing cycle. The number of days selected by the user will usually be based on experience and advice as to the humidity conditions for the user's geographical area, the location in which the humidor is kept, the size of the humidifier, and other factors which may increase or decrease the rate at which the humidifier uses water.

Once a preset timing interval is chosen using the timing interval switch 14, the LCD visual display panel 20 will show the number of days remaining until the electronic timing circuitry (not shown) within the humidor timer 10 counts down to "0". Therefore, the LCD visual display 20 will change from day to day during the countdown of the first timing cycle. The countdown of the first timing cycle begins when the user presses the first reset button 22. The word "water" is located adjacent the first reset button 22 thereby indicating that this button starts/resets the first timing cycle that reminds the user to add water to the humidifier.

Operational icon 26, which in this case looks like an arrow pointing to the "water" button 22, will begin flashing on the LCD visual display 20 indicating that the first timing cycle has been activated and is counting down to "0" from the first timing interval. During the countdown sequence, the remaining days in the first timing cycle will continue to be displayed on the LCD visual display 20.

When the first timing cycle counts down to "0", the first light display 16, herein comprising a red flashing LED, is activated. At this time the icon 26 freezes and appears to point at the "water" button 22 and the LCD display screen displays a flashing "O" indicating the first timing cycle has expired. It is obvious that other means of reminding the user the first timing cycle has expired could also be used such as a non-flashing LED or a beeping sound. Adjacent the red flashing LED can be an indication of the action to be performed. Here, the phrase "add water" is located adjacent the first light display 16 thereby indicating, along with the flashing "0" on the LCD visual display 20 and the frozen icon 26, that the user should add water to the humidifier. After the action indicated has been performed, the user can press the first reset button 22 which simultaneously recalls the preset first timing interval, starts the countdown of the new first timing cycle, deactivates the first light display 16, unfreezes the icon 26, and displays on the LCD visual display 20 the number of days currently remaining for the newly reset first timing cycle to again count down to "0".

If the timing interval switch 14 is moved after the first timing cycle has begun its countdown, the countdown will stop. By pressing the first reset button 22, the new preset timing interval will be recalled and a new first timing cycle countdown will begin.

Upon activating the humidor timer 10, a second timing cycle immediately begins counting down from a fixed, preset second timing interval, fixed at three months in the preferred embodiment. The user cannot alter or adjust the second timing interval. A second icon 28, similar to the first icon 26, will begin flashing on the LCD visual display 20 indicating that the second timing interval is activated. The icon 28 will continue to flash until the second timing cycle reaches "0" at which time the icon 28 will freeze and appear to point to the "solution" reset button 24 as discussed below.

The LCD visual display 20 continuously displays the days remaining in the first timing cycle as shown in FIG. 1. However, to view the days remaining in the second timing cycle, the user can press the second reset button 24 to change the visual display panel 20 so that it displays the number of days remaining in the second timing cycle, as shown in FIG. 2. The display shown in FIG. 2 is momentary, preferably of two seconds duration, at which time the display panel 20 again displays the days remaining in the first timing cycle. The word "solution" is located adjacent the second reset button 24, thereby indicating that this button allows the user to view to days remaining in the second timing cycle or to reset the second timing cycle.

When the second timing interval reaches "0", the second signal light 18, which may comprise an amber flashing LED, is activated. At this time, the second icon 28 freezes, indicating the second timing interval has expired. An indication of the action to be can be printed adjacent the amber flashing LED. Herein, the phrase "add special care solution" is located adjacent the second light display 18 to indicate to the user that the special care solution should be added to the humidifier. After the special care solution has been added to the humidifier, the user can press the second reset button 24 which recalls the second timing interval, deactivates the second signal light 18, and unfreezes the second icon 28. The second timing interval will not begin counting down until the second reset button 24 is then pressed again to activate the second timing cycle, repeating the operations previously explained above.

During the second timing cycle, the user can press a second cycle reset button 30, accessible from the side of the housing 12 through an aperture therein above the timing interval switch 14, to stop and reset the second timing cycle to the fixed second timing interval. The second cycle reset button 30 is preferably not easily accessible to reset the second timing cycle to avoid accidental resetting of the second timing interval. Here, an object such as the tip of a pen or the end of a paper clip or other piece of wire can be used to access the second cycle reset button 30 through housing aperture. However, the second reset button 24 must be pressed to activate the newly reset second timing cycle, whereby the operations of the second timing cycle as previously explained are repeated.

As explained above, the LCD visual display panel 20 continuously displays the days remaining in the first timing cycle. Further, the LCD visual display 20 continuously displays the first and second flashing icons 26 and 28 to indicate that both the first and second timing cycles are activated. The LCD visual display panel 20 also contains a low battery indicator icon 32 to indicate when the batteries 34 in the humidor timer 10 need to be replaced. If the batteries are low, the LED's 16 and 18 will not flash even though either or both of the first and second timing cycles have reached "0". When the low batteries are replaced, the LED's 16 and 18 will recover their original status.

Upon activation of the low battery indicator icon 32, the old batteries must be replaced within approximately two days to ensure continuous counting for both the first and second timing cycles. As shown in FIG. 3, the batteries are accessible through the battery door 36 located underneath the housing 12. Battery replacement must be completed within 10 seconds to ensure continuous counting for both the first and second timing cycles. After the new batteries are replaced, the humidor timer 10 will test the battery status within 5 minutes or the user can press the second reset button 24 to clear the low battery indicator icon 32.

The reset buttons 22 and 24 are preferably effective to reset the first and second timing cycles only when light displays 16 and 18 are lit, signalling the end of a given timing cycle. This feature prevents accidental resetting of a timing cycle. As an option, only one reset button, 22 or 24, could be provided, and that button may be depressed to reset whichever timing cycle has ended, as indicated by the energization of one of the display lights 16 or 18, without resetting the other timing cycle. In the latter case, there is a possibility that both display lights 16 and 18 could be energized at the same time, in which event both timing cycles could be reset simultaneously by depressing the single reset button.

If the humidor timer 10 operates improperly for any reason, the user can reset the timer to its original default setting by removing the batteries 34 from the battery compartment for one minute and then replacing the batteries. Optionally, the user may press a unit reset button 38 accessible by the use of a pin or piece of wire from the bottom of the housing 12. The unit reset button 38 is common in many electronic timers and is not discussed further herein.

The concepts involved in timers in accordance with this invention could also be applied to household or outdoor plant care. Instead of the "add water" legend beside the first light display 16, the legend could state "water plants" to remind the user to determine if plants need watering. In such case, the preset switchable periods of time could be, for example, one week, ten days, and two weeks. The second light display 18 could be marked "treat plants" to remind the user that the time has come to consider treatments such as feeding or pest control measures, and could have a preset single countdown time of, for example, four months.

The concepts of this invention could be used for a myriad of other situations in which timed reminders would be valuable. In its broadest aspects, the invention could be used whenever multiple timing intervals, one or more of which is switchable to different preset intervals by the user, is desired. Thus, there could be more than two timing functions, such as might be required for automotive maintenance, one or more of which is switchable to different intervals to meet the particular needs of the user.

What is claimed is:

1. A timer for alerting a user to perform two different tasks at different time intervals, said timer comprising:

a housing;

a counter within said housing for counting down a first time interval at the end of which a first task is to be performed and concurrently counting down a second time interval at the end of which a second task is to be performed;

a first signal device for indicating the expiration of said first time interval and a second signal device for indicating the expiration of said second time interval;

a manually-engageable first reset member for resetting the timer to start a new first time interval after the previous first time interval has ended so that a new first time interval may be started after completion of the first task;

a manually-engageable second reset member for resetting the timer to start a new second time interval after the previous second time interval has ended so that a new second time interval may be started after completion of the second task; and a visual display panel for optionally displaying the time remaining in the first time interval or the time remaining in the second time interval.

2. The timer of claim 1 wherein said first time interval is adjustable to at least two different pre-set periods of time, and said timer includes a user-engageable switch for selecting the pre-set period of time of said first time interval.

3. The timer of claim 2 wherein said second time interval is fixed.

4. The timer of claim 3 wherein said second time interval may be restarted before the end of said second time interval by a switch which is difficult to accidentally engage.

5. The timer of claim 1 wherein said second time interval is fixed.

6. The timer of claim 1 wherein said second time interval may be restarted before the end of said second time interval by a switch which is difficult to accidentally engage.

7. The timer of claim 1 wherein said display panel normally displays the time remaining in said first time interval but may be switched to momentarily display the time remaining in said second time interval.

8. The timer of claim 7 wherein said display panel may be switched to display the time remaining in said second time interval by manual engagement of said second reset member.

9. The timer of claim 1 wherein said timer is used for maintenance of a cigar humidor, wherein said first time interval is the number of days between which water should be added to a humidifier inside a cigar humidor and wherein said second time interval is the number of days between which a special solution should be added to the humidifier, and wherein said housing is marked with indicia appropriate to indicate whether the task to be performed is to add water or to add the special solution.

10. The timer of claim 1 wherein said timer is used for household or outdoor plant care, wherein said first time interval is the number of days between which it may be necessary to water plants and wherein said second time interval is the number of days between which other plant care should be considered, and wherein said housing is marked with indicia appropriate to indicate the tasks to be performed.

11. The timer of claim 1 wherein said timer is powered by batteries located in said housing.

12. The timer of claim 1 wherein said first signal device comprises a first flashing LED energized at the end of said first time interval and said second signal device comprises a second flashing LED energized at the end of said second time interval.

* * * * *